US008174543B2

(12) United States Patent
Yanai

(10) Patent No.: US 8,174,543 B2
(45) Date of Patent: May 8, 2012

(54) DISPLAY DEVICE DRIVING CIRCUIT OF WHICH POWER CONSUMPTION IS REDUCED, CONTROL METHOD THEREOF, AND DISPLAY DEVICE USING THE SAME

(75) Inventor: Koushirou Yanai, Kanagawa (JP)

(73) Assignee: Renesas Electronics Corporation, Kawasaki-shi, Kanagawa (JP)

( * ) Notice: Subject to any disclaimer, the term of this patent is extended or adjusted under 35 U.S.C. 154(b) by 973 days.

(21) Appl. No.: 12/216,612

(22) Filed: Jul. 8, 2008

(65) Prior Publication Data

US 2009/0015603 A1 Jan. 15, 2009

(30) Foreign Application Priority Data

Jul. 9, 2007 (JP) ..... 2007-179575

(51) Int. Cl.
*G09G 5/10* (2006.01)

(52) U.S. Cl. ..... 345/690; 345/89; 345/98; 345/204; 345/214; 341/126; 341/144; 341/152; 349/37

(58) Field of Classification Search ..... 345/87–89, 345/55–59, 690, 204, 214, 77, 63, 98; 341/126, 341/144–154; 349/19–23, 37
See application file for complete search history.

(56) References Cited

U.S. PATENT DOCUMENTS 6,674,420 B2 * 1/2004 Matsueda et al. ..... 345/87
2006/0022929 A1 * 2/2006 Hashimoto et al. ..... 345/96
2006/0103618 A1 * 5/2006 Miura ..... 345/96
2006/0232542 A1 * 10/2006 Nishi et al. ..... 345/98

FOREIGN PATENT DOCUMENTS

JP 2003-248466 9/2003

* cited by examiner

*Primary Examiner* — Lun-Yi Lao
*Assistant Examiner* — Priyank Shah
(74) *Attorney, Agent, or Firm* — McGinn IP Law Group, PLLC

(57) ABSTRACT

A display device driving circuit includes: a grayscale signal output circuit, grayscale signal lines, a grayscale voltage output circuit, grayscale voltage lines, a digital-analog conversion circuit, a first to third switches. The grayscale signal output circuit outputs complementary signals as a digital grayscale signal. The grayscale signal lines receive the complementary signals. The grayscale voltage output circuit outputs analog grayscale voltages. The grayscale voltage lines receive the analog grayscale voltages. The digital-analog conversion circuit selects and outputs one of the analog grayscale voltages in response to the complementary signals. The first switch shuts off a first connection path between the grayscale signal output circuit and the digital-analog conversion circuit. The second switch shuts off a second connection path between the grayscale voltage output circuit and the digital-analog conversion circuit. The third switch connects a third connection path between one of a pair of the grayscale signal lines to the other. The pair transfers a pair of the complementary signals.

17 Claims, 7 Drawing Sheets

DISPLAY DEVICE DRIVING CIRCUIT OF WHICH POWER CONSUMPTION IS REDUCED, CONTROL METHOD THEREOF, AND DISPLAY DEVICE USING THE SAME

INCORPORATION BY REFERENCE

This application is based upon and claims the benefit of priority from Japanese patent application No. 2007-179575 filed on Jul. 9, 2007, the disclosure of which is incorporated herein in its entirety by reference.

BACKGROUND OF THE INVENTION

1. Field of the Invention

The present invention relates to a display device driving circuit, a control method thereof, and a display device using the same. More specifically, the present invention relates to reducing power consumption.

2. Description of Related Art

Recently, a display device has been used for a portable terminal, and driven by a built-in battery of the portable terminal in many cases. Further, the number of outputs of a data-line driving circuit installed in one IC chip has been increased even in a display device that can use a commercial power supply. Therefore, there have been more demands to implement still lower power consumption for the data-line driving circuit of the display device.

FIG. 1 is a block diagram showing a typical data-line driving circuit of a display device. The data-line driving circuit is generally called a driver IC. As shown in FIG. 1, a driver IC 10 includes a serial-parallel conversion circuit 11, a latch circuit 12, a level shifter circuit 13, a grayscale voltage output circuit 14, a digital-analog conversion circuit 15, and an output circuit 16. In FIG. 1, a clock signal/bit data section 17 outputs bit data. The serial-parallel conversion circuit 11 receives the bit data, and outputs n-bit parallel data. A logic setting input signal section 18 controls the serial-parallel conversion circuit 11 and the latch circuit 12 by outputting a strobe signal to write the parallel data outputted from the serial-parallel conversion circuit 11 into the latch circuit 12. The parallel data written to the latch circuit 12 appears on latch data lines, and their voltage levels are shifted by the level shifter circuit 13. The n-bit parallel data outputted from the level shifter circuit 13 are supplied to the digital-analog conversion circuit 15. The grayscale voltage output circuit 14 generates a grayscale voltage using a $\gamma$ correction power supply, and outputs the generated grayscale voltage to the digital-analog conversion circuit 15 via a grayscale voltage line. When a voltage range on a positive side of the driver output differs from that on a negative side of the driver output (when a common voltage is constant), the grayscale voltage output circuit 14 generates $2^n$ number of grayscale voltages for the positive side and $2^n$ number of grayscale voltages for the negative side and outputs those voltages. When executing a common inversion drive, the grayscale voltage output circuit 14 generates $2^n$ number of grayscale voltages and outputs those voltages. The digital-analog conversion circuit 15 selects one of the grayscale voltages based on the n-bit parallel data. The output circuit 16 outputs the grayscale voltage selected by the digital-analog conversion circuit 15 as an output of the driver IC.

FIG. 2 is a circuit diagram showing a typical digital-analog conversion circuit and its related circuit. In FIG. 2, the level shifter circuit 13 includes n number of level shifters, receives n-kinds of complementary signals, shifts the voltages thereof, and outputs the n-kinds of complementary signals. A level shifter 20 that level-shifts a first bit of the complementary signal receives a signal L1 and an inverted signal L1B thereof, and outputs a signal S1 and an inverted signal S1B thereof. When the input signal L1 of the level shifter 20 is the High level, the inverted signal L1B is Low, the output signal S1 is the High level, and the inverted output signal S1B is Low. Further, when the input signal L1 of the level shifter 20 is Low, the inverted signal L1B is the High level, the output signal S1 is Low, and the inverted output signal S1B is the High level. The digital-analog conversion circuit 15 includes transistors arranged in matrix, and selects prescribed grayscale voltages from the $2^n$ number of grayscale voltages based on the n-kinds of complementary signals. In FIG. 2, there are $2^n$ number of grayscale voltage lines, and $2^n$ number of grayscale voltages are supplied to the digital-analog conversion circuit 15. In the meantime, the digital-analog conversion circuit 15 is connected to the level shifter circuit 13 via $2^n$ number of grayscale signal lines that are in pairs of two each. For example, when the output signal S1 of the level shifter 20 is the High level, a transistor 22 is turned on so that the grayscale voltage of a grayscale voltage line 23 is selected. At this time, the inverted output signal S1B of the level shifter 20 becomes Low. Thus, a transistor 24 is turned off so that the grayscale voltage of a grayscale voltage line 25 is not selected. In the meantime, when the output signal S1 of the level shifter 20 is Low, the transistor 22 is turned off so that the grayscale voltage of the grayscale voltage line 23 is not selected. At this time, the inverted output signal S1B of the level shifter 20 becomes the High level. Thus, the transistor 24 is turned on so that the grayscale voltage of the grayscale voltage line 25 is selected. Therefore, $2^{n-1}$ number of grayscale voltage lines are to be selected from the $2^n$ number of grayscale voltage lines, based on the complementary signals flown on a pair of grayscale signal lines connected to the first-bit level shifter 20. Further, $2^{n-2}$ number of grayscale voltage lines are to be selected from the $2^{n-1}$ number of grayscale voltage lines that are selected based on the first-bit complementary signals, based on the second-bit complementary signals flown on a pair of grayscale signal lines connected to the second-bit level shifter. In the same manner, $2^{n-3}$ number of grayscale voltage lines are to be selected from the $2^{n-2}$ number of grayscale voltage lines that are selected based on the first-bit and second-bit complementary signals, based on the third-bit complementary signals. Ultimately, a single grayscale voltage line is selected based on the n-kinds of complementary signals flown on the n-pairs of grayscale signal lines that are connected to the n number of level shifters. This grayscale voltage of the grayscale voltage line is outputted to the output circuit 16 as an analog signal.

As a related art, a data-line driving circuit of a display device is disclosed in Japanese Laid-Open Patent Application JP 2003-248466 A, which is designed to reduce the power consumption on a digital-analog conversion circuit. In this related art, the digital-analog conversion circuit in an LCD driver internal circuit is disclosed. The digital-analog conversion circuit has a function of judging an input signal from a level shifter circuit and recovering electric charges on output wirings depending on the sum total of the number of wirings whose logics are inverted. That is, when there are a large number of wirings whose logics are to be inverted in sequential digital grayscale signals, a pair of an output line and an inverted output line of a level shifter is short-circuited so as to recover the electric charges. For example, regarding the level shifter 20 shown in FIG. 2, the wiring of the output signal S1 and the wiring of the inverted output signal S1B are short-circuited to set output potentials of the both to a middle level of an "H" (High) level and an "L" (Low) level. With this, when the logic is to be inverted from the "H" level to the "L" level, it can be changed from the middle level to the "L" level. Meanwhile, when the logic is to be inverted from the "L" level to the "H" level, it can be changed from the middle level to the "H" level. This makes it possible to reduce the power consumption.

We have now discovered the following fact. The electric charge recovery function described in the related art of JP2003-248466A short-circuits the output wirings of the level shifter circuit while having the grayscale voltage continuously supplied to the digital-analog conversion circuit. In this case, an abnormal current is generated at the time of recovering the electric charge, which may result in having extra power consumption. FIG. 3 is a circuit diagram showing a problem of the related art technique. As shown in FIG. 3, at the time of recovering the electric charges, a switch 31 is turned on, and output wirings 32 and 33 of a level shifter 30 in a pair are short-circuited. It is expected for the voltage of the short-circuited output wiring 32, 33 to be in a value close to the middle of the voltages previously-applied to the output wirings 32, 33. However, the voltage normally exceeds a threshold voltage of transistors 34, 35. Since this voltage is applied to gates of the transistors 34 and 35, both of the transistors 34 and 35 are turned on. With this, the transistors 34 and 35 become electrically conductive, and grayscale voltages of different grayscales appear on grayscale voltage lines 36 and 37. That is, when recovering the electric charges by short-circuiting each of the pairs of the output wirings of the level shifter circuit, all the transistors within the digital-analog conversion circuit are turned on. This may result in having an abnormal current, shown with a dotted line in FIG. 3, generated between the different grayscale voltages. With this related art technique, there is a possibility of losing the function of reducing the power consumption by recovering the electric charges, because of the abnormal current.

SUMMARY

The present invention seeks to solve one or more of the above problems, or to improve upon those problems at least in part. In one embodiment, a display device driving circuit includes: a grayscale signal output circuit configured to output a plurality of complementary signals as a digital grayscale signal; a plurality of grayscale signal lines configured to receive the plurality of complementary signals; a grayscale voltage output circuit configured to output a plurality of analog grayscale voltages; a plurality of grayscale voltage lines configured to receive the plurality of analog grayscale voltages; a digital-analog conversion circuit configured to select and output one of the plurality of analog grayscale voltages supplied through the plurality of grayscale voltage lines in response to the plurality of complementary signals supplied through the plurality of grayscale signal lines; a first switch configured to shut off a first connection path between the grayscale signal output circuit and the digital-analog conversion circuit through the plurality of grayscale signal lines; a second switch configured to shut off a second connection path between the grayscale voltage output circuit and the digital-analog conversion circuit through the plurality of grayscale voltage lines; and a third switch configured to connect a third connection path between one of a pair of the plurality of grayscale signal lines to the other. The pair transfers a pair of the plurality of complementary signals.

In another embodiment, a display device includes: a display panel; and a display device driving circuit. The display panel includes: a plurality of data lines, a plurality of gate lines configured to extendedly provided in a direction different from the plurality of data lines, a plurality of pixels configured to be provided at positions where the plurality of data lines and the plurality of gate lines intersect with each other, and a gate driver configured to drive the plurality of gate lines. The display device driving circuit includes: a grayscale signal output circuit configured to output a plurality of complementary signals as a digital grayscale signal, a plurality of grayscale signal lines configured to receive the plurality of complementary signals, a grayscale voltage output circuit configured to output a plurality of analog grayscale voltages, a plurality of grayscale voltage lines configured to receive the plurality of analog grayscale voltages, a digital-analog conversion circuit configured to select and output one of the plurality of analog grayscale voltages supplied through the plurality of grayscale voltage lines in response to the plurality of complementary signals supplied through the plurality of grayscale signal lines, a first switch configured to shut off a first connection path between the grayscale signal output circuit and the digital-analog conversion circuit through the plurality of grayscale signal lines; a second switch configured to shut off a second connection path between the grayscale voltage output circuit and the digital-analog conversion circuit through the plurality of grayscale voltage lines, and a third switch configured to connect a third connection path between one of a pair of the plurality of grayscale signal lines to the other, wherein the pair transfers a pair of the plurality of complementary signals. The display device driving circuit drives the plurality of data lines using output from digital-analog conversion circuit.

In another embodiment, a control method of a display device driving circuit, wherein said display device driving circuit includes: a grayscale signal output circuit configured to output a plurality of complementary signals as a digital grayscale signal, a plurality of grayscale signal lines configured to receive said plurality of complementary signals, a grayscale voltage output circuit configured to output a plurality of analog grayscale voltages, a plurality of grayscale voltage lines configured to receive said plurality of analog grayscale voltages, a digital-analog conversion circuit configured to select and output one of said plurality of analog grayscale voltages supplied through said plurality of grayscale voltage lines in response to said plurality of complementary signals supplied through said plurality of grayscale signal lines, a first switch configured to shut off a first connection path between said grayscale signal output circuit and said digital-analog conversion circuit through said plurality of grayscale signal lines, a second switch configured to shut off a second connection path between said grayscale voltage output circuit and said digital-analog conversion circuit through said plurality of grayscale voltage lines, and a third switch configured to connect a third connection path between one of a pair of said plurality of grayscale signal lines to the other, wherein said pair transfers a pair of said plurality of complementary signals, said control method includes: controlling said first switch, said second switch, and said third switch such that said first switch is turned on to connect said first connection path, said second switch is turned on to connect said second connection path, and said third switch is turned off to shut off said third connection path in a driving period; and controlling said first switch, said second switch, and said third switch such that said first switch is turned off to shut off said first connection path, said second switch is turned off to shut off said second connection path, and said third switch is turned on to connect said third connection path in a electric charges recovery period.

In the present invention, when the first switch shuts off the first connection path, transfer of the electric charges between the grayscale signal output circuit and the digital-analog conversion circuit is shut-off. Thus, it becomes possible to recover the electric charges by the third switch connecting the third connection path to short-circuit the pair of the grayscale signal lines. Further, when the second switch shuts off the second connection path, the supply of the grayscale voltages is shut-off. Thus, no abnormal current is generated between the different grayscale voltage lines during the electric charge recovery.

With the present invention, it is possible to reduce the power consumption by providing the third switch. At the same time, it is possible to suppress the abnormal current generated due to the electric charge recovery action by providing a second switch.

BRIEF DESCRIPTION OF THE DRAWINGS

The above and other objects, advantages and features of the present invention will be more apparent from the following description of certain preferred embodiments taken in conjunction with the accompanying drawings, in which.

DESCRIPTION OF THE PREFERRED EMBODIMENTS

The invention will be now described herein with reference to illustrative embodiments. Those skilled in the art will recognize that many alternative embodiments can be accomplished using the teachings of the present invention and that the invention is not limited to the embodiments illustrated for explanatory purposed.

Embodiments of a display device driving circuit, a control method thereof, and the display device using the same according to the present invention will be described below with reference to the attached drawings.

Figure 1:
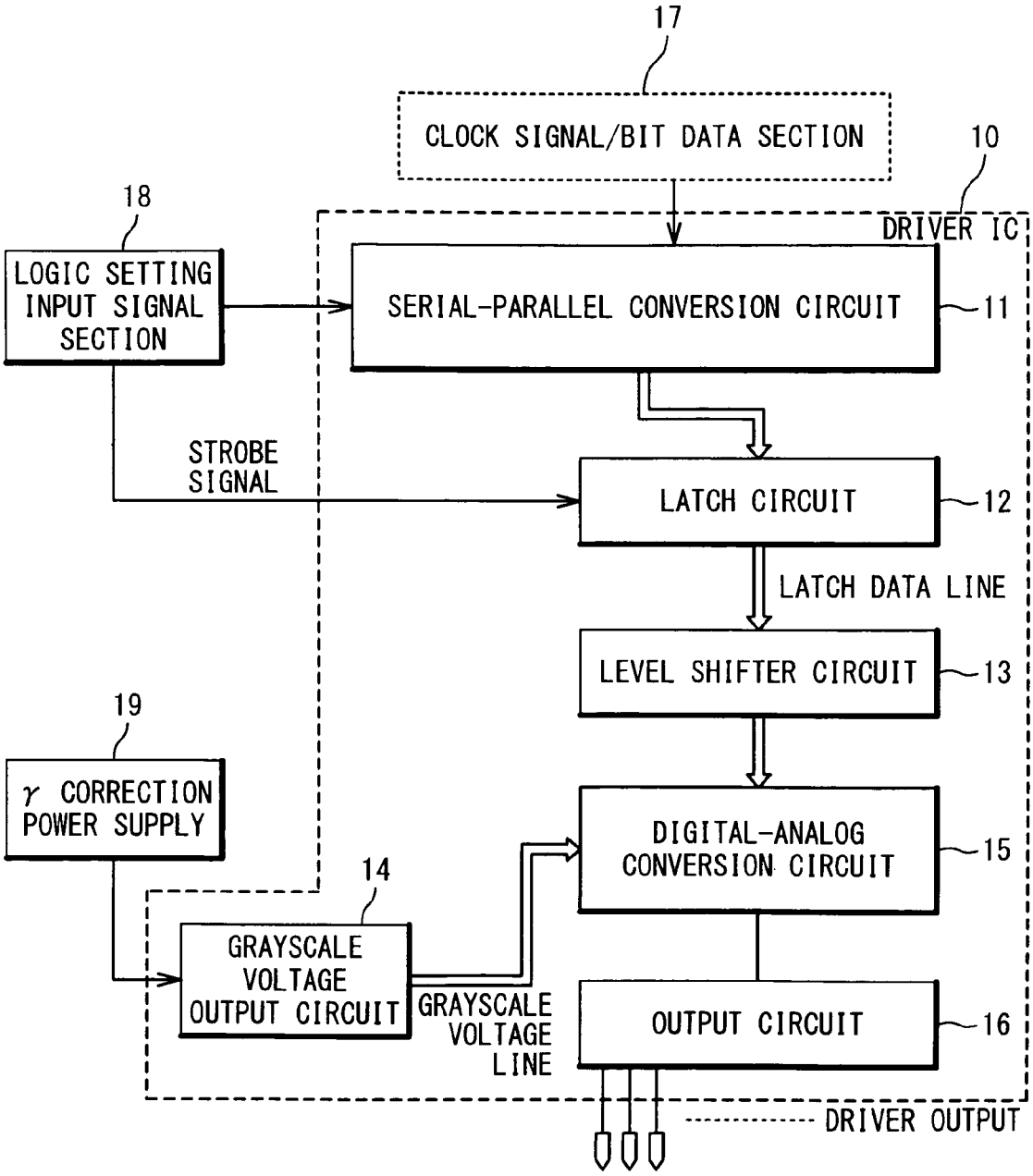
Fig. 1 PRIOR ART
FIG. 1 is a block diagram showing of a typical data-line driving circuit of a display device.
Figure 2:
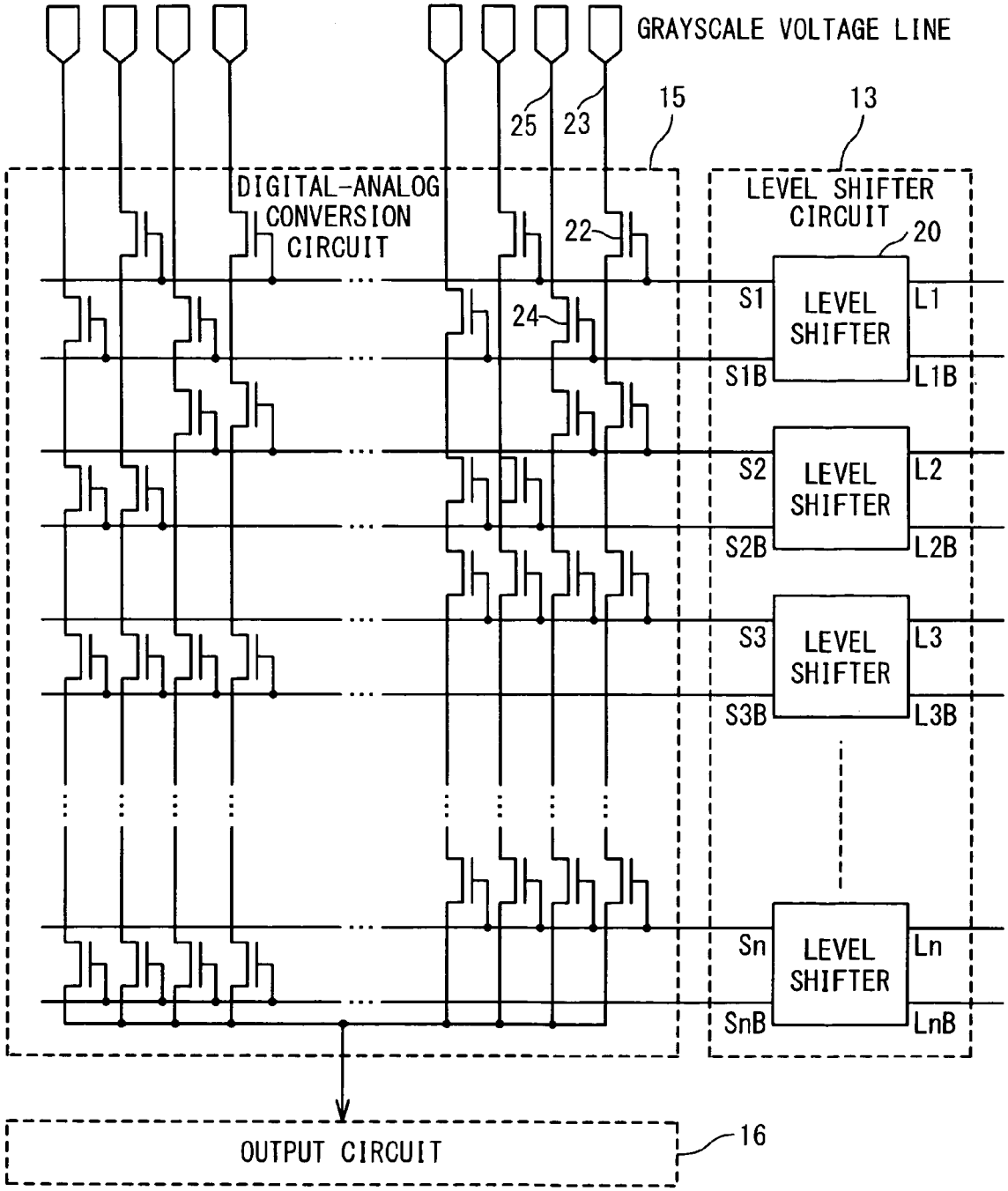
Fig. 2 PRIOR ART
FIG. 2 is a circuit diagram showing of the typical digital-analog conversion circuit and its related circuit.
Figure 3:
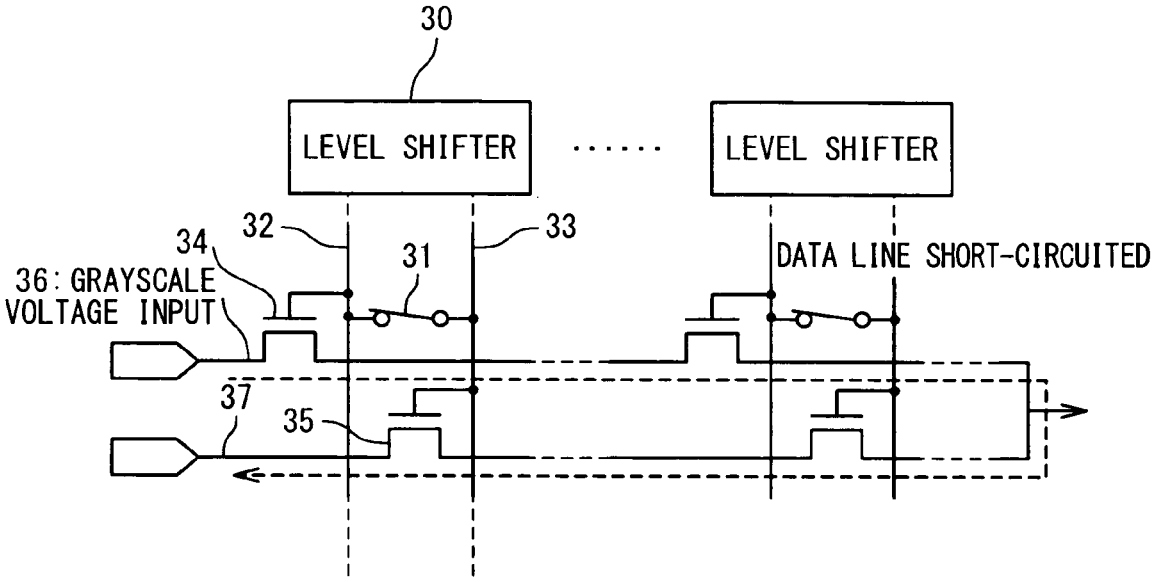
Fig. 3 PRIOR ART
FIG. 3 is a circuit diagram showing a problem of the related art technique.
Figure 4:
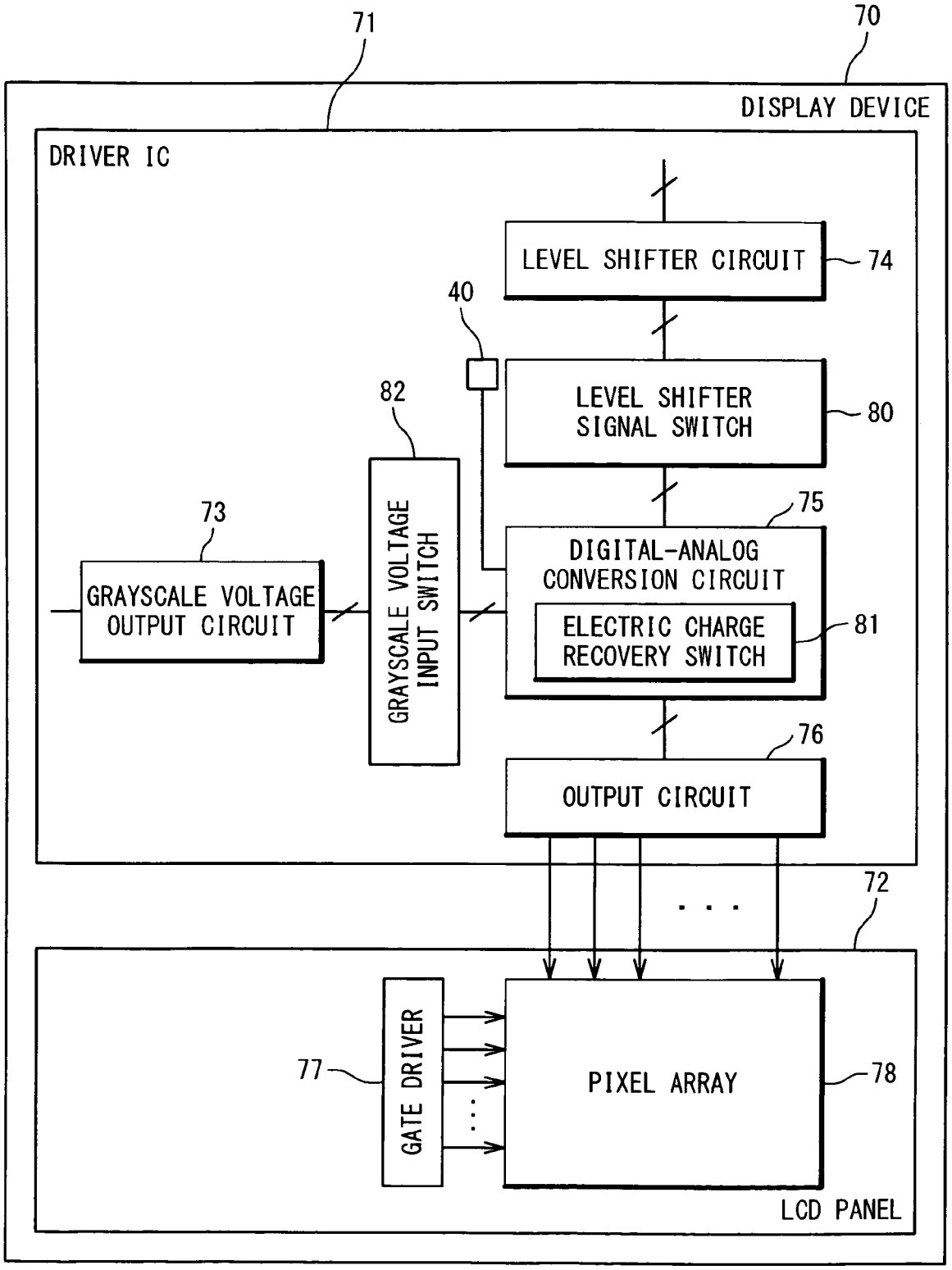
FIG. 4 is a view showing a block diagram of an embodiment of the display device according to the present invention.
Figure 7:
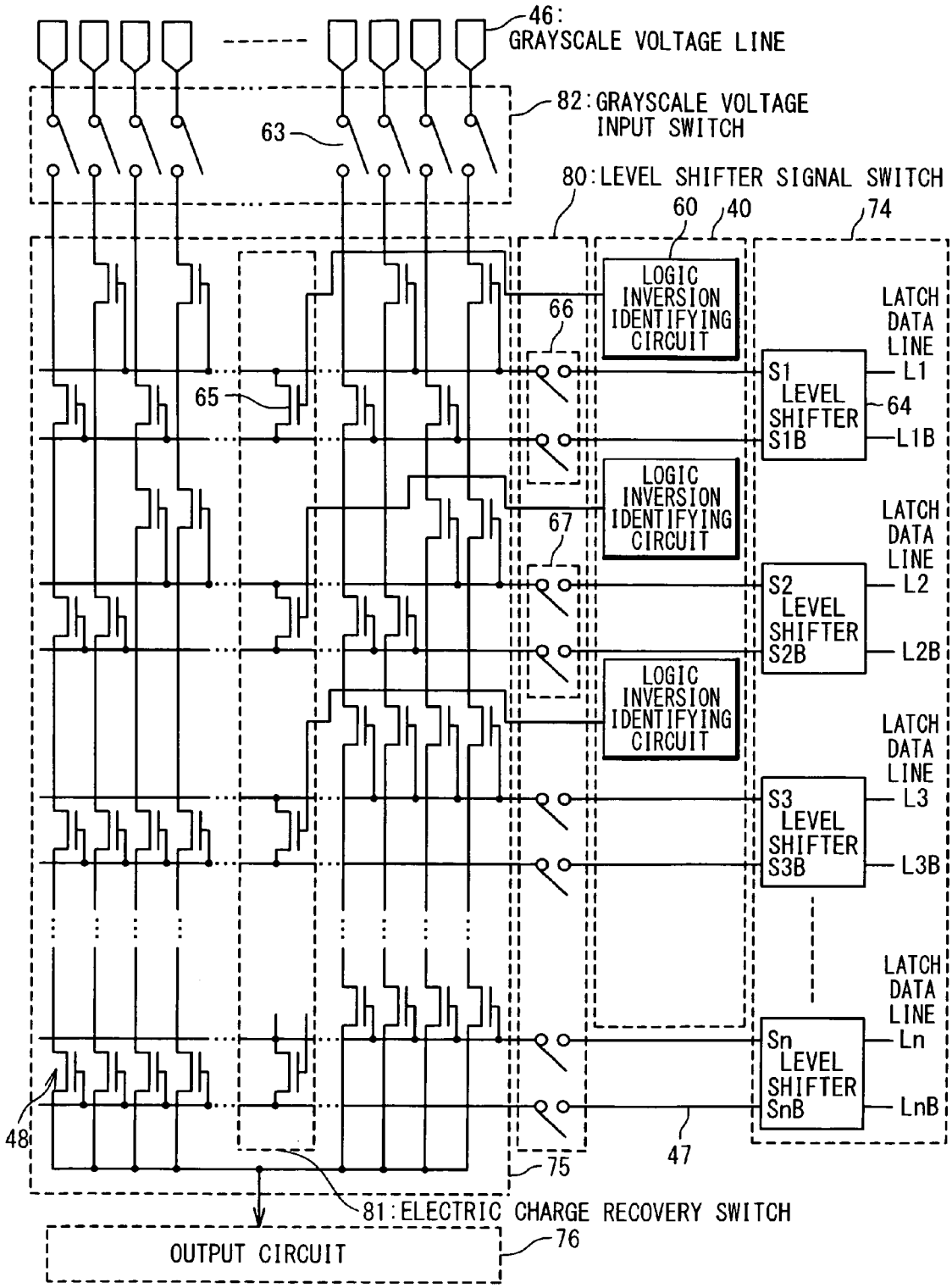
FIG. 7 is a circuit diagram showing another embodiment of the driving circuit according to the present invention.

FIG. 4 is a view showing a block diagram of an embodiment of the display device according to the present invention. In FIG. 7, a display device 70 includes a driver IC 71 and an LCD panel 72. The driver IC 71 includes a grayscale voltage output circuit 73, a level shifter circuit 74, a digital-analog conversion circuit 75, and an output circuit 76. In addition, the driver IC 71 further includes a level shifter signal switch 80, an electric charge recovery switch 81, a grayscale voltage input switch 82, and a logic inversion identifying circuit 40. The level shifter signal switch 80 is controlled to be turned off at the time of recovering electric charges so as to electrically isolate the level shifter circuit 74 and the digital-analog conversion circuit 75 to shut-off migration of the electric charges. The electric charge recovery switch 81 is controlled to be turned on at the time of recovering the electric charges so as to short-circuit pairs of grayscale signal lines to recover the electric charges. The electric charge recovery switch 81 is included in the digital-analog conversion circuit 75. The grayscale voltage input switch 82 is controlled to be turned off at the time of recovering the electric charges so as to electrically isolate the grayscale voltage output circuit 73 and the digital-analog conversion circuit 75 to prevent generation of an abnormal current. An operation for recovering the electric charges will be described later. The logic inversion identifying circuit 40 will be explained later.

Incidentally, each of the level shifter signal switch 80, the electric charge recovery switch 81, the grayscale voltage input switch 82, and the logic inversion identifying circuit 40 may be include or may not be included in the digital-analog conversion circuit 75. The level shifter circuit 74 is regarded as the grayscale signal output circuit.

The LCD panel 72 includes a gate driver 77 and a pixel array 78. The pixel array 78 includes a plurality of data lines (not shown) extendedly provided in a perpendicular direction, a plurality of gate lines (not shown) extendedly provided in a horizontal direction, and a plurality of pixels (not shown) provided at positions where the plurality of data lines and the plurality of gate lines intersect with each other. The gate driver 77 scans and drives the plurality of gate lines, and the driver IC 71 drives the plurality of data lines.

Figure 5:
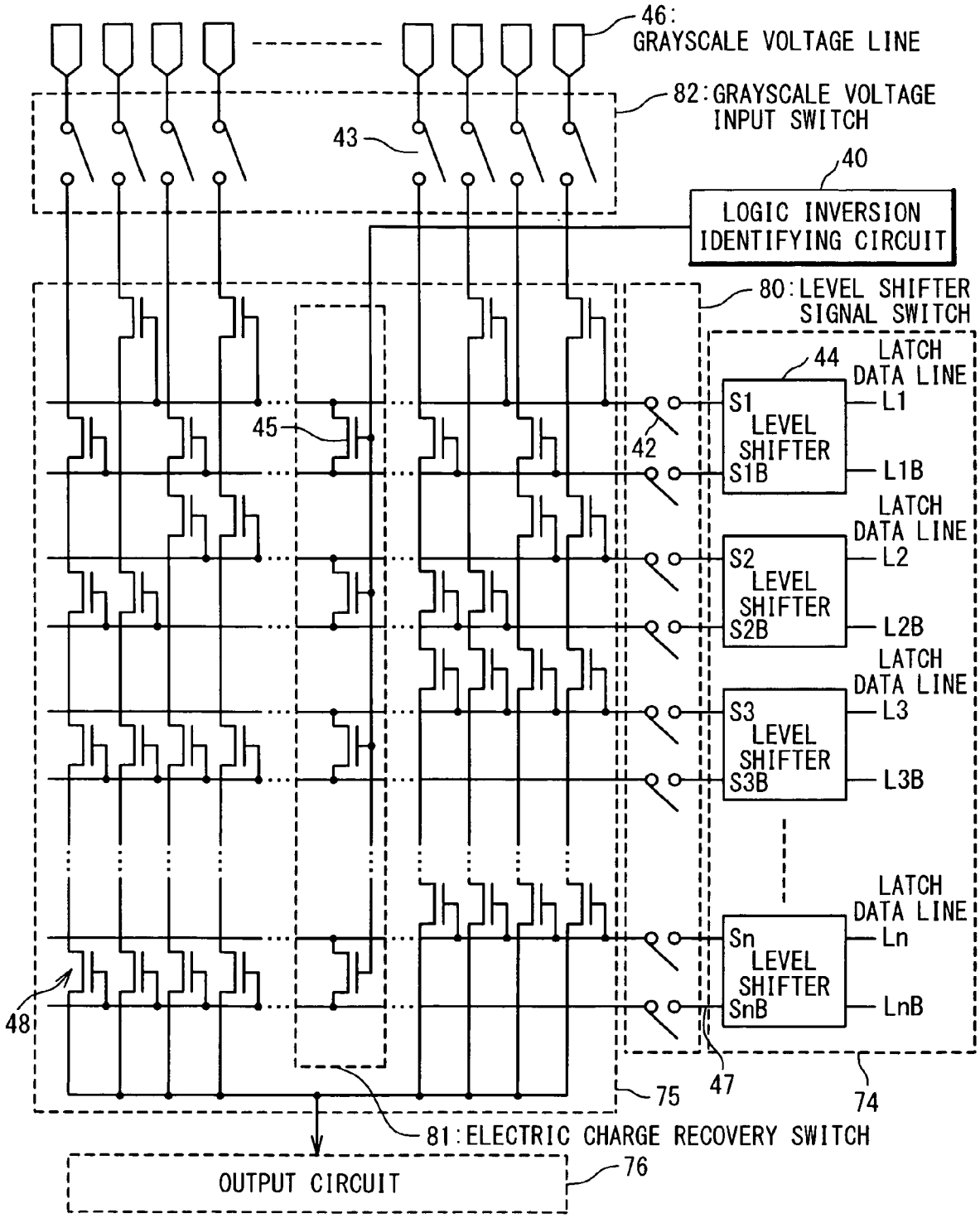
FIG. 5 is a circuit diagram showing an embodiment of the driving circuit according to the present invention.

FIG. 5 is a circuit diagram showing an embodiment of the driving circuit according to the present invention. As shown in FIG. 5, in driver IC 71 (the driving circuit), the digital-analog conversion circuit 75 includes grayscale signal lines 47, grayscale voltage lines 46, and transistors 48.

The grayscale signal lines 47 transmit complementary signals outputted from the level shifter circuit 74. The grayscale voltage lines 46 transmit grayscale voltages generated from the γ correction power supply. The transistors 48 are arranged in matrix for working to select a prescribed grayscale voltage based on the complementary signals outputted from the level shifter circuit 74, such as the transistors in the digital-analog conversion circuit 75.

An input side of the level shifter circuit 74 is connected to 2n number of latch data lines. For the 2n number of latch data lines, two latch data lines whose logics are inverted from each other are arranged in a pair. In FIG. 5, L1 and L1B, which are input signals of a level shifter 44, make a pair. Similarly, L2 and L2B, L3 and L3B, L4 and L4B, . . . , Ln and LnB are in pairs. When the input signal L1 is the High level, the inverted input signal L1B is the Low level. When the input signal L1 is the Low level, the inverted input signal L1B is the High level. Further, for the signals outputted from the level shifter circuit 74, two lines (grayscale voltage lines 46) having inverted logics from each other are arranged in a pair. In FIG. 5, S1 and S1B, which are output signals of the level shifter 44, make a pair. Similarly, S2 and S2B, S3 and S3B, S4 and S4B, . . . , Sn and SnB are in pairs. When the output signal S1 is the High level, the inverted output signal S1B is the Low level. When the input signal S1 is the Low level, the inverted input signal S1B is the High level. The level shift circuit 74 receives the input signals L1 and L1B, L2 and L2B, L3 and L3B, L4 and L4B, Ln and LnB, and level-shifts those to output the output signals S1 and S1B, S2 and S2B, S3 and S3B, S4 and S4B, . . . , Sn and SnB.

A level shifter signal switch 80 controls signals which are outputted form the level shifter circuit 74 and supplied to the digital-analog conversion circuit 75. When switches 42 of the level shifter signal switch 80 is turned on, the level shifter circuit 74 and the digital-analog conversion circuit 75 are electrically connected, and the output signals S1 and S1B, S2 and S2B, S3 and S3B, S4 and S4B, . . . , and Sn and SnB are supplied to the digital-analog conversion circuit 75. Based on these output signals, the digital-analog conversion circuit 75 selects and outputs the grayscale voltage. When the switches 42 of the level shifter signal switch 80 is turned off, transfer of electric charges between the level shifter circuit 74 and the digital-analog conversion circuit 75 is shut off. This makes it possible to recover the electric charges by short-circuiting each of the pairs of grayscale signal lines 47 that transmit complementary signals. Turning on and off of the switches 42 in the level shifter signal switch 80 are controlled by the logic inversion identifying circuit 40. The level shifter signal switch 80 is regarded to be a first switch which shuts off a first connection path between the level shifter circuit 74 and the digital-analog conversion circuit 75 through the plurality of grayscale signal lines 47.

The electric charge recovery switch 81 includes n number of transistors 45. Each transistor 45 is disposed at each of n number of pairs of the grayscale signal lines 47. Turning on and off of the transistors 45 in the electric charge recovery switch 81 are controlled by the logic inversion identifying circuit 40. The transistor 45 is disposed for one pair of the grayscale signal lines 47 connected to the level shifter 44. When the transistor 45 is controlled to be turned on, the transistor 45 operates to short-circuit a grayscale signal line 47 that receives the signal S1 and a grayscale signal line 47 that receives the signal S1B so that a potential of the grayscale signal line 47 receiving the signal S1 and a potential of the grayscale signal line 47 receiving the signal S1B become a same level. Inserting positions of the transistors 45 in the electric charge recovery switch 81 may be at any positions as longs as those are at a latter stage of the level shifter signal switch 80. However, when those are disposed at about the center of the lateral direction in the digital-analog conversion circuit 75 in FIG. 5, a CR-time constant by a line resistance, a line capacity, and the gate capacitances of the switch transistors constituting the digital-analog conversion circuit 75 becomes the minimum. Therefore, this is more preferable in terms of an electric charge recovering efficiency. The electric charge recovery switch 81 is regarded to be a third switch which connects a third connection path between one of a pair of the plurality of grayscale signal lines 47 to the other.

A grayscale voltage input switch 82 is disposed on the input side of the digital-analog conversion circuit 75 which receives $2^n$-kinds of grayscale voltages. The grayscale voltage input switch 82 includes $2^n$ number of switches 43, and each switch 43 is inserted to each line of the $2^n$ number of the grayscale voltage lines 46. When the switches 43 of the grayscale voltage input switch 82 are turned on, the $2^n$ number of the grayscale voltage lines 46 are connected to the digital-analog conversion circuit 75, and the $2^n$-kinds of the grayscale voltages are supplied to the digital-analog conversion circuit 75 via the grayscale voltage lines 46. With this, the digital-analog conversion circuit 75 can be operated to select a grayscale voltage. When the switches 43 of the grayscale voltage input switch 82 are turned off, the $2^n$ number of the grayscale voltage lines 46 are open, so that the grayscale voltages are not supplied to the digital-analog conversion circuit 75. This makes it possible to prevent generation of an abnormal current during an electric charge recovery period. Turning on and off of the switches 43 in the grayscale voltage input switch 82 are controlled by the logic inversion identifying circuit 40. The grayscale voltage input switch 82 is regarded to be a second switch which shuts off a second connection path between the grayscale voltage output circuit 73 and the digital-analog conversion circuit 75 through the plurality of grayscale voltage lines 46.

The logic inversion identifying circuit 40 compares the sequential digital grayscale signals, and controls the electric charge recovery switch 81 based on the result thereof. The sequential digital grayscale signals are, for example, supplied from the latch circuit provided at the former stage of the level shifter circuit 74. Here, when the logics of (n/2)+1 pairs of lines or more among the n-pairs of the grayscale signal lines 47 are inverted, the logic inversion identifying circuit 40 operates to control the switches 45 of the electric charge recovery switch 81 to be turned on in order to recover the electric charges. In the meantime, when the logics of (n/2) pairs of lines or less are inverted, the logic inversion identifying circuit 40 operates to control the switches 45 of the electric charge recovery switch 81 to be turned off in order not to recover the electric charges.

Here, when the logics of (n/2)+1 pairs of lines or more among the n-pairs of the grayscale signal lines 47 are inverted, in order to recover the electric charges, the logic inversion identifying circuit 40 controls the grayscale voltage input switch 82 to be turned off and the level shifter signal input switch 80 to be turned off. When the logics of (n/2) pairs of lines or less are inverted, in order not to recover the electric charges, the logic inversion identifying circuit 40 controls the grayscale voltage input switch 82 to be turned on and the level shifter signal input switch 80 to be turned on.

For example, there will be described a case where "n=6", the k-th digital grayscale signal is "100011", and (k+1)-th digital grayscale signal is "011110". First, in a driving period (k), the k-th digital grayscale signal "100011" is outputted from the level shifter circuit 74. At this time, the logic inversion identifying circuit 40 controls the level shifter signal switch 80 to be turned on, the grayscale voltage input switch 82 to be turned on, and the electric charge recovery switch 81 to be turned off. With this, the digital-analog conversion circuit 75 operates to select and output the grayscale voltage that corresponds to the digital grayscale signal "1100011". Then, it is shifted to an electric charge recovery period (k). When the grayscale signal "100011" is compared with the sequential grayscale signal "011110", 5 bits among 6-bit data are inverted. At this time, it can be considered that the logics of "(n/2)+1=4" pairs of lines or more are inverted. Thus, the logic inversion identifying circuit 40 operates to recover the electric charges. The logic inversion identifying circuit 40 applies voltages to the gates of each transistor 45 of the electric charge recovery switch 81 so as to turn on the electric charge recovery switch 81 to recover the electric charges. With this, the potentials of the short-circuited lines come to have the middle values that are almost equivalent. In this electric charge recovery period (k), the logic inversion identifying circuit 40 controls the level shifter signal switch 80 and the grayscale voltage input switch 82 to be turned off. By controlling the level shifter signal switch 80 to be turned off, transfer of the electric charges between the level shifter circuit 74 and the digital-analog conversion circuit 75 is shut-off. Thus, it becomes possible to recover the electric charges by short-circuiting the pair of the grayscale signal lines 47. Further, by controlling the grayscale voltage input switch 82 to be turned off, the $2^n$-kinds of the grayscale voltages supplied to the digital-analog conversion circuit 75 are shut-off. Thus, no abnormal current is generated between the different grayscale voltage lines 46 in this electric charge recovery period (k). Subsequently, it is shifted to a driving period (k+1), and the (k+1)-th digital grayscale signal "011110" is outputted from the level shifter circuit 74. At this time, the logic inversion identifying circuit 40 controls the level shifter signal switch 80 to be turned on, the grayscale voltage input switch 82 to be turned on, and the electric charge recovery switch 81 to be turned off. Since the electric charges are recovered in the electric charge recovery period (k), each output of the level shifters 44 is in the middle level between the Low level and the High level. Therefore, the first bit and the sixth bit are changed from the middle level to the Low level, and the second bit, the third bit, the fourth bit, and the fifth bit are changed from the middle level to the High level. As a result, the power consumption can be reduced.

Next, for example, there will be described a case where "n=6", the (k+1)-th digital grayscale signal is "011110", and (k+2)-th digital grayscale signal is "011000". First, in a driving period (k+1), the (k+1)-th grayscale digital signal "011110" is outputted from the level shifter circuit 74. At this time, the logic inversion identifying circuit 40 controls the level shifter signal switch 80 to be turned on, the grayscale voltage input switch 82 to be turned on, and the electric charge recovery switch 81 is to be turned off. With this, the digital-analog conversion circuit 75 operates to select and output the grayscale voltage that corresponds to the digital grayscale signal "011110". Then, it is shifted to an electric charge recovery period (k+1). When the grayscale signal "011110" is compared with the sequential grayscale signal "011000", 2 bits among 6-bit data are inverted. At this time, it can be considered that the logics of "(n/2)=3" pairs of lines or less are inverted. Thus, the logic inversion identifying circuit 40 operates not to recover the electric charges. The logic inversion identifying circuit 40 controls the electric charge recovery switch 81 to be turned off. In the electric charge recovery period (k+1), the level shifter signal switch 80, and the grayscale voltage input switch 82 may well be turned off or on. In order to simplify the circuit for controlling the switches 42 and 43, the grayscale voltage input switch 82 and the level shifter signal switch 80 can be turned off at all times during the electric charge recovery period. In the meantime, by keeping the grayscale voltage input switch 82 and the level shifter signal switch 80 to be turned on when the electric charges are not recovered, it is possible to save the power that is consumed unnecessarily for the operation of the switches 42 and 43 when the electric charges are not recovered. Subsequently, it is shifted to a driving period (k+2), and the (k+2)-th digital grayscale signal "011000" is outputted from the level shifter circuit 74. At this time, the logic inversion identifying circuit 40 controls the level shifter signal switch 80 to be turned on, the grayscale voltage input switch 82 to be turned on, and the electric charge recovery switch 81 to be turned off. Since the electric charges are not recovered in the electric charge recovery period (k+1), the output from the level shifter circuit 74 is "LHHHHL". Here, "L" and "H" show the Low level and High level, respectively. Thus, when the (k+2)-th digital signal "011000" appears, the fourth bit and the fifth bit are changed from "H" to "L", thereby consuming the power. However, the first bit and the sixth bit remain as "L", and the second bit and the third bit remain as "H". Thus, there is no significant amount of increase in the power consumption.

Figure 6:
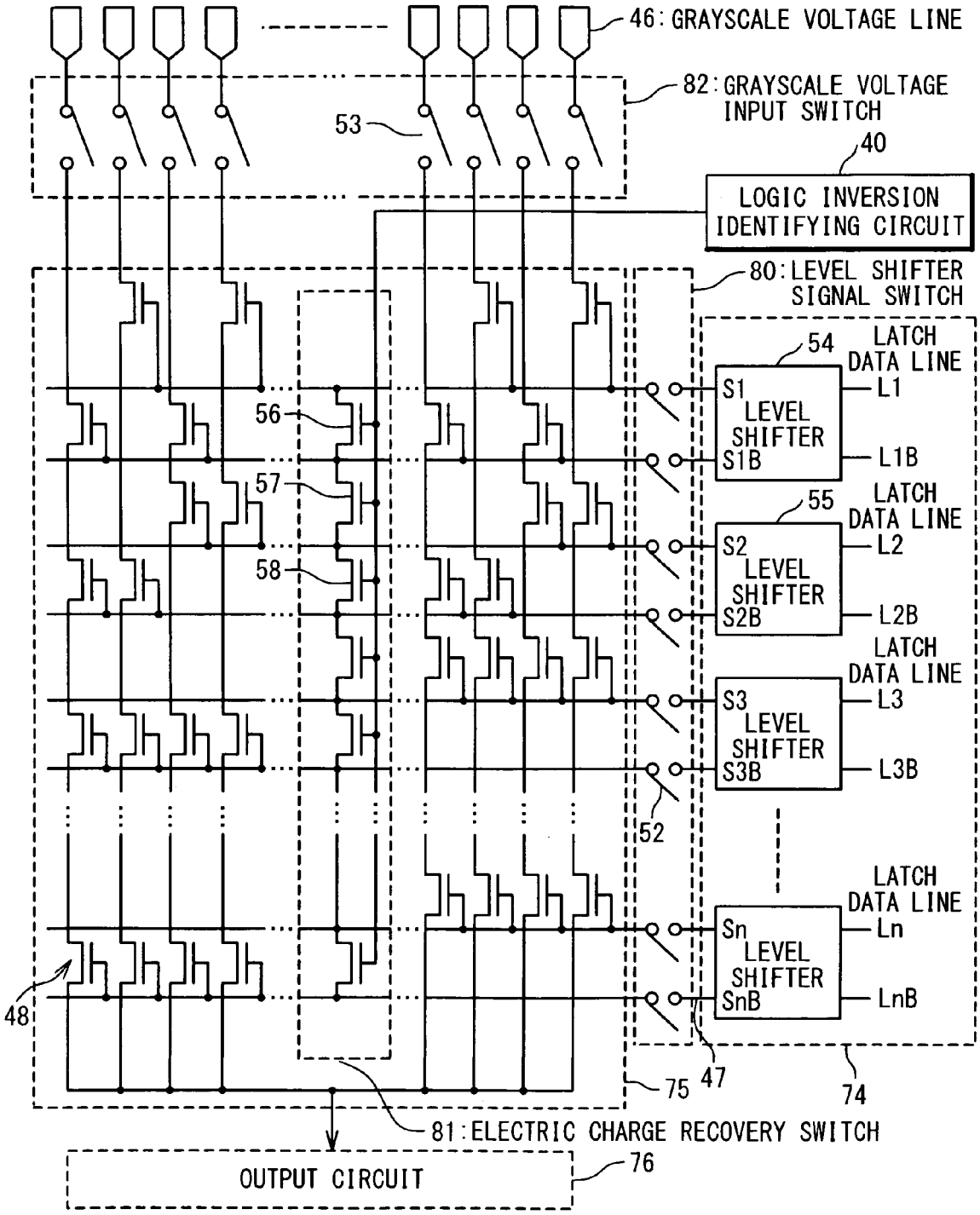
FIG. 6 is a circuit diagram showing another embodiment of the driving circuit according to the present invention.

FIG. 6 is a circuit diagram showing another embodiment of the driving circuit according to the present invention. As shown in FIG. 6, as in the case of the foregoing embodiment, the driver IC 71 (the driving circuit) of the present embodiment includes: a digital-analog conversion circuit 75, an electric charge recovery switch 81 including transistors (56, 57, 58); a logic inversion identifying circuit 40 for controlling the electric charge recovery switch 81; a level shifter signal switch 80 including switches 52; and a grayscale voltage input switch 82 including switches 53. The digital-analog conversion circuit 75 includes grayscale signal lines 46, grayscale voltage lines 47, and transistors 48.

Compared with the foregoing embodiment, in the electric charge recovery switch 81 of the present embodiment, transistors are additionally provided between the pairs of the grayscale signal lines 47, wherein the pairs are connected to the neighboring level shifters. In FIG. 6, for example, a level shifter 54 for level-shifting the first bit of the digital grayscale signal outputs an output signal S1 and an inverted output signal S1B. Further, a level shifter 55 for level-shifting the second bit of the digital grayscale signal outputs an output signal S2 and an inverted output signal S2B. When the level shifter signal switch 80 as well as the grayscale voltage input switch 82 is turned off and the electric charge recovery switch 81 is turned on in the electric charge recovery period, the transistors of the electric charge recovery switch 81 become electrically conductive. When a transistor 56 becomes electrically conductive, a pair of the grayscale signal lines 47 connected to the first-bit level shifter 54 are short-circuited. When a transistor 58 becomes electrically conductive, a pair of the grayscale signal lines 47 connected to the second-bit level shifter 55 are short-circuited. In the present embodiment, a transistor 57 is provided between these two pairs, and becomes also electrically conductive. Therefore, short-circuit also occurs between the pair of the grayscale signal lines connected to the level shifter 54 and the pair of grayscale signal lines connected to the level shifter 55. There is a variation between a voltage generated after short-circuiting the pair of the grayscale signal lines 47 connected to the level shifter 54 and a voltage generated after short-circuiting the pair of the grayscale signal lines 47 connected to the level shifter 55. However, the variation in those voltages can be absorbed by an effect of the transistor 57, so that the electric charge recovering effect can be improved further.

FIG. 7 is a circuit diagram showing another embodiment of the driving circuit according to the present invention.

As shown in FIG. 7, as in the case of the foregoing embodiment, the driver IC 71 (the driving circuit) of the present embodiment includes: a digital-analog conversion circuit 75, an electric charge recovery switch 81 including transistors 65; a logic inversion identifying circuit 40 for controlling the electric charge recovery switch 81; a level shifter signal switch 80 including switches (66, 67); and a grayscale voltage input switch 82 including switches 63. The digital-analog conversion circuit 75 includes grayscale signal lines 46, grayscale voltage lines 47, and transistors 48. The logic inversion identifying circuit 40 includes logic inversion identifying circuits 60.

Compared with the foregoing embodiment, the logic inversion identifying circuit 60 can be provided to each level shifter 64 in the level shifter circuit 74. Each logic inversion identifying circuit 60 controls the transistor 65 that short-circuits a pair of the grayscale signal lines 47 connected to the corresponding level shifter 64. In FIG. 7, for example, the logic inversion identifying circuit 60 compares the sequential digital grayscale signals for one bit, which are supplied to the level shifter 64 corresponding to the logic inversion identifying circuit 60. When the logics thereof are inverted, the logic conversion identifying circuit 60 controls the electric charge recovery switch 81 to recover the electric charges. In the meantime, when the logics are not inverted, the logic conversion identifying circuit 60 controls the electric charge recovery switch 81 not to recover the electric charges.

For example, it is assumed that the first bit of the k-th digital grayscale signal is "0", and the first bit of the (k+1)-th bit digital grayscale signal is "1". Here, after performing digital-analog conversion on the k-th digital grayscale signal in the driving period (k), the logic inversion identifying circuit 60 controls the transistor 65 in the electric charge recovery switch 81 to be turned on in the electric charge recovery period (k) With this, the transistor 65 of the electric charge recovery switch 81 becomes electrically conductive, so that a pair of the grayscale signal lines 47 connected to the level shifter 64 is short-circuited. In this electric charge recovery period (k), a switch portion 66 that corresponds to the first bit of the level shifter signal switch 80 is controlled to be turned off. The grayscale voltage input switch 82 is also controlled to be turned off. When it is shifted to the driving period (k+1) and digital-analog conversion is performed on the (k+1)-th digital grayscale signal, the output of the first bit is changed from the middle level to "H". Therefore, the power consumption can be reduced.

Next, there will be described a case where the second bit of the k-th digital grayscale signal is "1", and the second bit of the (k+1)-th bit digital grayscale signal is also "1". Here, after performing digital-analog conversion on the k-th digital grayscale signal in the driving period (k), the second-bit logic inversion identifying circuit 60 controls the transistor 65 of the electric charge recovery switch 81, which short-circuits the output of the second bit, to be turned off in the electric charge recovery period (k). With this, the output of the second-bit level shifter 64 remains as "H". It is the same as in the foregoing embodiments that a switch portion 67 corresponding to the second bit of the level shifter signal switch 80 is controlled to be turned on or off in the electric charge recovery period (k). When it is shifted to the driving period (k+1) and digital-analog conversion is performed on the (k+1)-th digital grayscale signal, the output of the second bit remains to be "H". Therefore, no extra power is to be consumed. In this electric charge recovery period (k), the grayscale voltage input switch 81 is controlled to be turned off when electric charges on one of the bits are recovered. In the case of FIG. 7, the logic inversion identifying circuits 60 are disposed by corresponding to each level shifter 64. Thus, it is possible to identify logic inversion individually for each of the lines, thereby making it possible to recover the electric charges more efficiently.

In the above embodiments, each of the switches used in the level shifter signal switch 80 and the grayscale voltage input switch 82 may be exemplified by a transistor, and a combination thereof such as a transfer gate.

It is apparent that the present invention is not limited to the above embodiment, but may be modified and changed without departing from the scope and spirit of the invention.

What is claimed is:

1. A display device driving circuit comprising:

a grayscale signal output circuit configured to output a plurality of complementary signals as a digital grayscale signal;

a plurality of grayscale signal lines configured to receive said plurality of complementary signals;

a grayscale voltage output circuit configured to output a plurality of analog grayscale voltages;

a plurality of grayscale voltage lines configured to receive said plurality of analog grayscale voltages;

a digital-analog conversion circuit configured to select and output one of said plurality of analog grayscale voltages supplied through said plurality of grayscale voltage lines in response to said plurality of complementary signals supplied through said plurality of grayscale signal lines;

a first switch configured to shut off a first connection path between said grayscale signal output circuit and said digital-analog conversion circuit through said plurality of grayscale signal lines;

a second switch configured to shut off a second connection path between said grayscale voltage output circuit and said digital-analog conversion circuit through said plurality of grayscale voltage lines; and a third switch configured to connect a third connection path between one of a pair of said plurality of grayscale signal lines to the other, wherein said pair transfers a pair of said plurality of complementary signals.

2. The display device driving circuit according to claim 1, wherein when said first switch shuts off said first connection path and said second switch shuts off said second connection path, said third switch connects said third connection path.

3. The display device driving circuit according to claim 1, wherein electric charges in said pair of plurality of grayscale signal lines are recovered by turning on of said third switch to connect said third connection path.

4. The display device driving circuit according to claim 1, further comprising:

a logic inversion identifying circuit configured to detect that a digital data in a (k+1)-th digital grayscale signal is inverted in comparison with that in a k-th digital grayscale signal, and control said third switch based on said detection result of said logic inversion identifying circuit.

5. The display device driving circuit according to claim 4, wherein said logic inversion identifying circuit includes:

a logic inversion identifying portion configured to detect that an i-th bit data in said (k+1)-th digital grayscale signal is inverted in comparison with that in said k-th digital grayscale signal, and control said third switch based on said detection result of said logic inversion identifying portion.

6. The display device driving circuit according to claim 1, wherein said third switch further connects a fourth connection path between said pair of the plurality of grayscale signal lines to anther pair of said plurality of grayscale signal lines, in addition to said third connection path.

7. A display device comprising:

a display panel; and a display device driving circuit, wherein said display panel includes:

a plurality of data lines, a plurality of gate lines configured to extendedly provided in a direction different from said plurality of data lines, a plurality of pixels configured to be provided at positions where said plurality of data lines and said plurality of gate lines intersect with each other, and a gate driver configured to drive said plurality of gate lines, wherein said display device driving circuit includes:

a grayscale signal output circuit configured to output a plurality of complementary signals as a digital grayscale signal, a plurality of grayscale signal lines configured to receive said plurality of complementary signals, a grayscale voltage output circuit configured to output a plurality of analog grayscale voltages, a plurality of grayscale voltage lines configured to receive said plurality of analog grayscale voltages, a digital-analog conversion circuit configured to select and output one of said plurality of analog grayscale voltages supplied through said plurality of grayscale voltage lines in response to said plurality of complementary signals supplied through said plurality of grayscale signal lines, a first switch configured to shut off a first connection path between said grayscale signal output circuit and said digital-analog conversion circuit through said plurality of grayscale signal lines;

a second switch configured to shut off a second connection path between said grayscale voltage output circuit and said digital-analog conversion circuit through said plurality of grayscale voltage lines, and a third switch configured to connect a third connection path between one of a pair of said plurality of grayscale signal lines to the other, wherein said pair transfers a pair of said plurality of complementary signals, wherein said display device driving circuit drives said plurality of data lines using output from digital-analog conversion circuit.

8. The display device according to claim 7, wherein when said first switch shuts off said first connection path and said second switch shuts off said second connection path, said third switch connects said third connection path.

9. The display device according to claim 7, wherein electric charges in said pair of plurality of grayscale signal lines are recovered by turning on of said third switch to connect said third connection path.

10. The display device according to claim 7, wherein said display device driving circuit further includes:

a logic inversion identifying circuit configured to detect that a digital data in a (k+1)-th digital grayscale signal is inverted in comparison with that in a k-th digital grayscale signal, and control said third switch based on said detection result of said logic inversion identifying circuit.

11. The display device according to claim 10, wherein said logic inversion identifying circuit includes:

a logic inversion identifying portion configured to detect that an i-th bit data in said (k+1)-th digital grayscale signal is inverted in comparison with that in said k-th digital grayscale signal, and control said third switch based on said detection result of said logic inversion identifying portion.

12. The display device according to claim 7, wherein said third switch further connects a fourth connection path between said pair of the plurality of grayscale signal lines to anther pair of said plurality of grayscale signal lines, in addition to said connection path.

13. A control method of a display device driving circuit, wherein said display device driving circuit includes:

a grayscale signal output circuit configured to output a plurality of complementary signals as a digital grayscale signal, a plurality of grayscale signal lines configured to receive said plurality of complementary signals, a grayscale voltage output circuit configured to output a plurality of analog grayscale voltages, a plurality of grayscale voltage lines configured to receive said plurality of analog grayscale voltages, a digital-analog conversion circuit configured to select and output one of said plurality of analog grayscale voltages supplied through said plurality of grayscale voltage lines in response to said plurality of complementary signals supplied through said plurality of grayscale signal lines, a first switch configured to shut off a first connection path between said grayscale signal output circuit and said digital-analog conversion circuit through said plurality of grayscale signal lines, a second switch configured to shut off a second connection path between said grayscale voltage output circuit and said digital-analog conversion circuit through said plurality of grayscale voltage lines, and a third switch configured to connect a third connection path between one of a pair of said plurality of grayscale signal lines to the other, wherein said pair transfers a pair of said plurality of complementary signals, said control method comprising:

controlling said first switch, said second switch, and said third switch such that said first switch is turned on to connect said first connection path, said second switch is turned on to connect said second connection path, and said third switch is turned off to shut off said third connection path in a driving period; and controlling said first switch, said second switch, and said third switch such that said first switch is turned off to shut off said first connection path, said second switch is turned off to shut off said second connection path, and said third switch is turned on to connect said third connection path in a electric charges recovery period.

14. The control method of a display device driving circuit according to claim 13, further comprising:

controlling said first switch, said second switch, and said third switch such that said third switch is turned off to shut off said third connection path in an electric charges recovery period.

15. The control method of a display device driving circuit according to claim 13, wherein said display device driving circuit further includes:

a logic inversion identifying circuit configured to detect that a digital data in a (k+1)-th digital grayscale signal is inverted in comparison with that in a k-th digital grayscale signal, wherein said controlling step in said electric charges recovery period, includes:

controlling said third switch based on said detection result of said logic inversion identifying circuit.

16. The control method of a display device driving circuit according to claim 15, wherein said logic inversion identifying circuit includes:

a logic inversion identifying portion configured to detect that an i-th bit data in said (k+1)-th digital grayscale signal is inverted in comparison with that in said k-th digital grayscale signal, wherein said controlling step in said electric charges recovery period, includes:

controlling said third switch based on said detection result of said logic inversion identifying portion.

17. The control method of a display device driving circuit according to claim 13, wherein said controlling step in said electric charges recovery period, includes:

controlling said third switch such that said third switch further connects a fourth connection path between said pair of the plurality of grayscale signal lines to anther pair of said plurality of grayscale signal lines, in addition to said third connection path.

* * * * *